US009284929B2

(12) United States Patent
Nakai et al.

(10) Patent No.: US 9,284,929 B2
(45) Date of Patent: Mar. 15, 2016

(54) ELECTROMAGNETIC FUEL INJECTION VALVE

(75) Inventors: Hirotaka Nakai, Hitachinaka (JP); Motoyuki Abe, Mito (JP); Toru Ishikawa, Kitaibaraki (JP); Yasuo Namaizawa, Naka (JP); Nobuaki Kobayashi, Maebashi (JP); Kiyoshi Yoshii, Takasaki (JP); Hitoshi Furudate, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 757 days.

(21) Appl. No.: 13/638,382

(22) PCT Filed: Apr. 1, 2011

(86) PCT No.: PCT/JP2011/058444

§ 371 (c)(1),
(2), (4) Date: Nov. 27, 2012

(87) PCT Pub. No.: WO2011/125946

PCT Pub. Date: Oct. 13, 2011

(65) Prior Publication Data

US 2013/0087639 A1 Apr. 11, 2013

(30) Foreign Application Priority Data

Apr. 1, 2010 (JP) ..... 2010-084778

(51) Int. Cl.
*F02M 51/06* (2006.01)
*F02M 51/00* (2006.01)
(Continued)

(52) U.S. Cl.
CPC ..... *F02M 51/061* (2013.01); *F02M 51/0671* (2013.01); *F02M 51/0685* (2013.01); *F02M 61/20* (2013.01); *F02M 2200/306* (2013.01)

(58) Field of Classification Search
CPC . F02M 51/0685; F02M 61/20; F02M 61/205; F02M 2200/306
USPC ..... 239/533.9, 585.1, 585.2
See application file for complete search history.

(56) References Cited

U.S. PATENT DOCUMENTS 5,950,931 A * 9/1999 Beatty ..... F02M 57/02 239/533.8
2004/0069274 A1* 4/2004 Brenk ..... F02M 61/205 123/446

(Continued)

FOREIGN PATENT DOCUMENTS

JP 3-74568 A 3/1991
JP 9-119362 A 5/1997

(Continued)

OTHER PUBLICATIONS

International Search Report with English translation dated May 10, 2011 (three (3) pages).

*Primary Examiner* — Len Tran
*Assistant Examiner* — Alexander Valvis
(74) *Attorney, Agent, or Firm* — Crowell & Moring LLP

(57) ABSTRACT

An electromagnetic fuel injection valve includes: a valve element which closes a fuel passage by coming into contact with a valve seat and opens the fuel passage by going away from the valve seat; an electromagnet which includes a coil and a magnetic core formed as a drive portion for driving the valve element; a movable element which is held by the valve element in a state where the movable element is displaceable in the direction of a drive force of the valve element relative to the valve element; a first biasing portion for biasing the valve element in the direction opposite to the direction of a drive force generated by the drive portion; a second biasing portion for biasing the movable element in the direction of the drive force with a biasing force smaller than the biasing force generated by the first biasing portion; and a restricting portion for restricting the displacement of the movable element in the direction of the drive force relative to the valve element.

2 Claims, 7 Drawing Sheets

(51) Int. Cl.

| | |
|---|---|
| ***F02M 61/00*** | (2006.01) |
| ***F02M 63/00*** | (2006.01) |
| ***F02M 61/20*** | (2006.01) |

(56) References Cited

U.S. PATENT DOCUMENTS

2007/0194152 A1 8/2007 Abe et al.
2007/0284455 A1* 12/2007 Suzuki ..... F02M 47/027 239/96
2008/0276907 A1 11/2008 Abe et al.
2009/0188996 A1 7/2009 Abe et al.
2009/0314257 A1* 12/2009 Ishimura ..... F02M 61/205 123/467

FOREIGN PATENT DOCUMENTS

JP 2007-218204 A 8/2007
JP 2008-280876 A 11/2008

* cited by examiner

ELECTROMAGNETIC FUEL INJECTION VALVE

TECHNICAL FIELD

The present invention relates to a fuel injection valve used in an internal combustion engine, and more particularly to an electromagnetic fuel injection valve which performs opening/closing of a valve element in such a manner that a magnetic flux is generated in a magnetic circuit which includes a movable element and a core by supplying an electric current to a coil thus applying a magnetic attraction force which attracts the movable element toward the core to the movable element.

BACKGROUND ART

Patent literature 1 discloses a fuel injection valve which holds a movable element by a valve element in a relatively displaceable manner in the driving direction of the valve element, and includes a first biasing means for biasing the valve element in the direction opposite to the direction of a drive force, a second biasing means for biasing the movable element in the direction of the drive force with a biasing force smaller than a biasing force generated by the first biasing means, and a restricting means which restricts the displacement of the movable element in the direction of the drive force relative to the valve element. In such a fuel injection valve disclosed in patent literature 1, the responsiveness of the valve element can be enhanced at the time of opening the valve, and the secondary injection where fuel is injected due to bounding of the valve element can be suppressed at the time of closing the valve. Further, the movable element and the valve element are formed as separate parts from each other and hence, unstable bounding of the movable element at the time of opening the valve can be suppressed thus making a control of a minute fuel injection amount easy.

Further, patent literature 2 discloses a fuel injection device of an internal combustion engine where a nozzle port is formed in one end of a compressed air passage and a fuel supply port is formed in a middle portion of the compressed air passage, a distal end portion of a valve element plays a role of opening or closing the nozzle port, a rear end of the valve element is engaged with one end of the movable element, the valve element is biased toward the movable element by a biasing means (first biasing means) for biasing the valve element in the direction opposite to the direction of a drive force thus closing the nozzle port, the movable element is biased toward the valve element by a biasing means (second biasing means) for biasing the movable element in the direction of the drive force, the valve element is displaced against a biasing force of the biasing means for biasing the valve element in the direction opposite to the direction of the drive force by electromagnetically driving the movable element thus closing the nozzle port, and fuel supplied to the inside of the compressed air passage from the fuel supply port is injected from the nozzle port by compressed air, wherein assuming a mass of the valve element as $M_1$, a mass of the movable element as $M_2$, a biasing force of the biasing means (first biasing means) for biasing the valve element in the direction opposite to the direction of the drive force in a nozzle port closed state as $F_1$, and a biasing force of the biasing means (second biasing means) for biasing the movable element in the direction of the drive force in a nozzle port closed state as $F_2$, a value calculated by $(F_1/F_2-1)\times M_2/(M_1+M_2)$ is 0.3 or less. In such a fuel injection valve, by setting the above-mentioned calculated value to 0.3 or less, after the nozzle port is closed once, kinetic energy applied to the movable element can be reduced so that it is possible to reduce an amount of displacement of the valve element which is generated by the re-collision of the movable element with the valve element after overshooting.

CITATION LIST

Patent Literature

Patent literature 1: JP-A-2007-218204
Patent literature 2: JP-A-3-074568

SUMMARY OF THE INVENTION

Technical Problem

In the fuel injection valve described in patent literature 1, the movable element and the valve element are formed as separate parts from each other and hence, when the movable element bounds, the valve element is brought into a state where only a magnetic attraction force which is a drive force and a biasing force of the biasing means (second biasing means) for biasing the movable element in the direction of the drive force act on the movable element so that the movable element can be easily brought into a stable and close contact state with the core whereby unstable bounding of the movable element at the time of opening the valve can be suppressed. Further, it is possible to suppress the secondary injection where fuel is injected due to bounding of the valve element at the time of closing the valve.

However, patent literature 1 fails to disclose a method of setting a biasing force of the biasing means (second biasing means) for biasing the movable element in the direction of the drive force for suppressing the secondary injection generated due to re-collision of the movable element with the valve element by quickly stabilizing the movement of the movable element after overshooting of the movable element at the time of closing the valve while suppressing bounding of the movable element at the time of opening the valve.

Further, in the fuel injection valve described in patent literature 2, it is intended to suppress the secondary injection generated by the re-collision of the movable element with the valve element after overshooting of the movable element at the time of closing the valve by setting a value which is calculated based on a mass of the valve element, a mass of the movable element, a biasing force for biasing the valve element in the direction opposite to the direction of a drive force, and a biasing force for biasing the movable element in the direction of the drive force within the above-mentioned numerical value range.

However, in the method described in patent literature 2, a lift amount of the valve element is not included as a parameter. Particularly, in a fuel injection valve for cylinder injection of fuel of recent years, to realize the high-speed injection at a high fuel pressure, it is necessary to set a small lift amount compared to a conventionally known fuel injection valve. Accordingly, sensitivity of lift amount with respect to an injection amount becomes large and hence, it is necessary to change a lift amount corresponding to an injection amount.

The above-mentioned condition under which the secondary injection is generated is influenced by a valve closing speed of the valve element and hence, even when a value of lift amount is changed with a small lift amount, it is necessary to introduce a condition under which the secondary injection can be prevented. However, patent literature 2 fails to disclose a method of setting a proper biasing force with respect to a condition under which a stroke is changed or which a stroke is small as described above.

Further, from a viewpoint of suppressing an exhaust gas discharged from an internal combustion engine, it is known that the injection performed plural times in a divided manner within one stroke is effective. When the injection is divided in this manner, it is necessary to re-open the valve within a short time after closing the valve. However, both patent literature 1 and patent literature 2 also fail to disclose a method of setting a biasing force by which the valve can be quickly re-opened in a stable manner.

The present invention provides a fuel injection valve which can prevent the generation of secondary injection at the time of closing the valve while suppressing unstable bounding of a movable element at the time of opening the valve. The present invention also provides a fuel injection valve which can control a minute fuel injection amount and can inject fuel in divided multiple stages at short injection intervals by quickly stabilizing the movable element after closing the valve.

Solution to Problem

According to a first aspect of the present invention, there is provided an electromagnetic fuel injection valve which includes: a valve element which closes a fuel passage by coming into contact with a valve seat and opens the fuel passage by going away from the valve seat; an electromagnet which includes a coil and a magnetic core formed as a drive portion for driving the valve element; a movable element which is held by the valve element in a state where the movable element is displaceable in the direction of a drive force of the valve element relative to the valve element; a first biasing portion for biasing the valve element in the direction opposite to the direction of a drive force generated by the drive portion; a second biasing portion for biasing the movable element in the direction of the drive force with a biasing force smaller than the biasing force generated by the first biasing portion; and a restricting portion for restricting the displacement of the movable element in the direction of the drive force relative to the valve element.

According to a second aspect of the present invention, in the electromagnetic fuel injection valve of the first aspect, the biasing force (N) of the second biasing portion is preferably set smaller than a sum of a value which is obtained by multiplying a product of a valve closing speed (m/s) of the valve element and a mass (kg) of the movable element by $-7.5\times10^3$ and a value which is obtained by multiplying a sum (kg) of the mass of the movable element and a mass of the valve element by $2.6\times10^3$.

According to a third aspect of the present invention, in the electromagnetic fuel injection valve of the second aspect, the biasing force (N) of the second biasing portion is preferably set larger than a value obtained by multiplying a value which is obtained by dividing the product of the valve closing speed (m/s) of the valve element and the mass (kg) of the movable element by a minimum injection interval (s) by which continuous sprayings are independently performable when the injection is performed 2 times or more by 2.0.

Advantageous Effects of Invention

According to the present invention, the fuel injection valve can quickly stabilize the movable element after closing the valve while suppressing the secondary injection. Accordingly, a control of a minute fuel injection amount becomes possible and hence, it becomes possible to realize the divided multi-stage injection at a minimum injection interval or less by which continuous sprayings can be independently performed when the injection is performed 2 times or more.

DESCRIPTION OF EMBODIMENTS

With respect to a fuel injection valve explained hereinafter, there is provided the fuel injection valve which can prevent the generation of secondary injection at the time of closing the valve while suppressing unstable bounding of a movable element at the time of opening the valve. The fuel injection valve which can also control a minute fuel injection amount and can inject fuel in divided multiple stages at short injection intervals by quickly stabilizing the movable element after closing the valve.

Hereinafter, an embodiment is explained.

Figure 1:
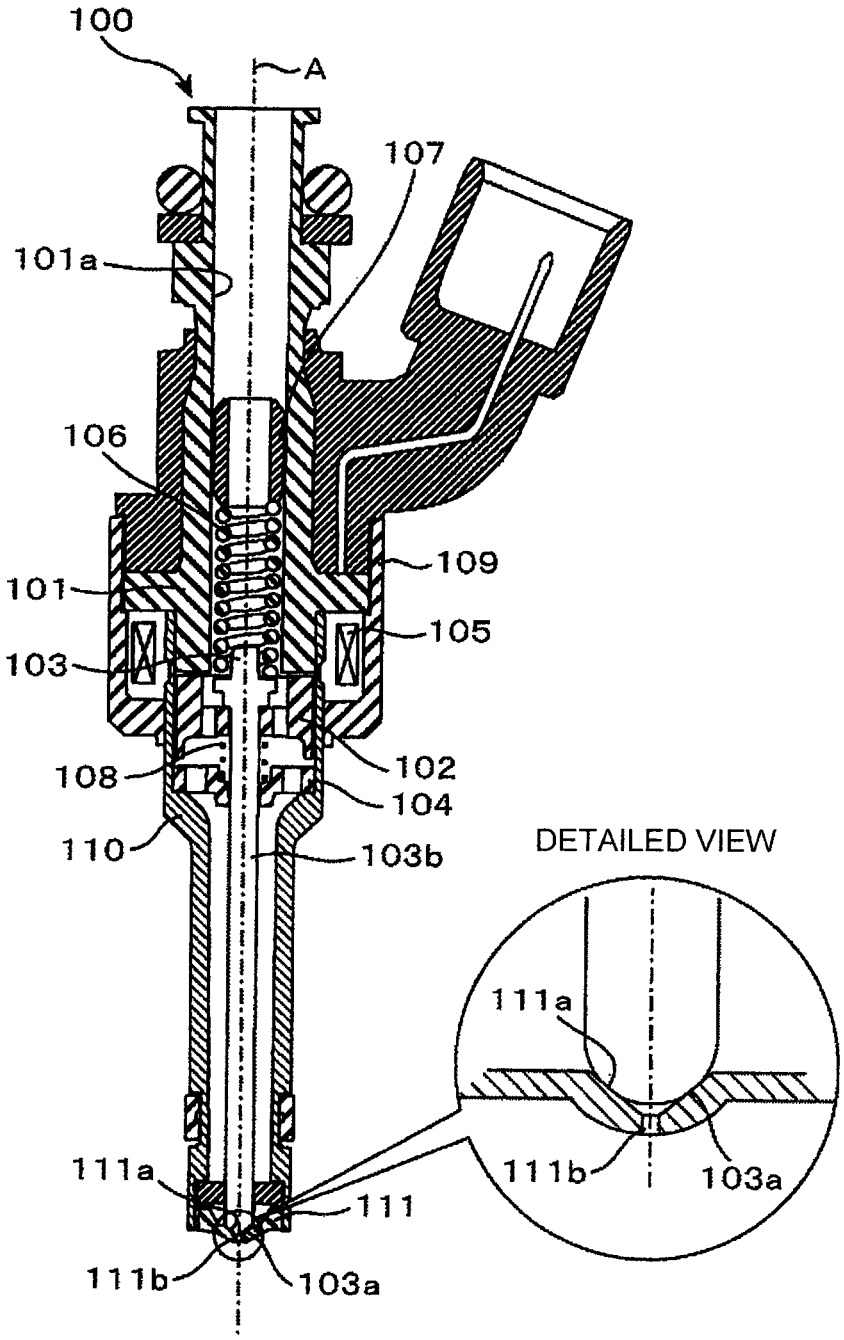
FIG. 1 A cross-sectional view showing an embodiment of a fuel injection valve according to the present invention.
Figure 2:
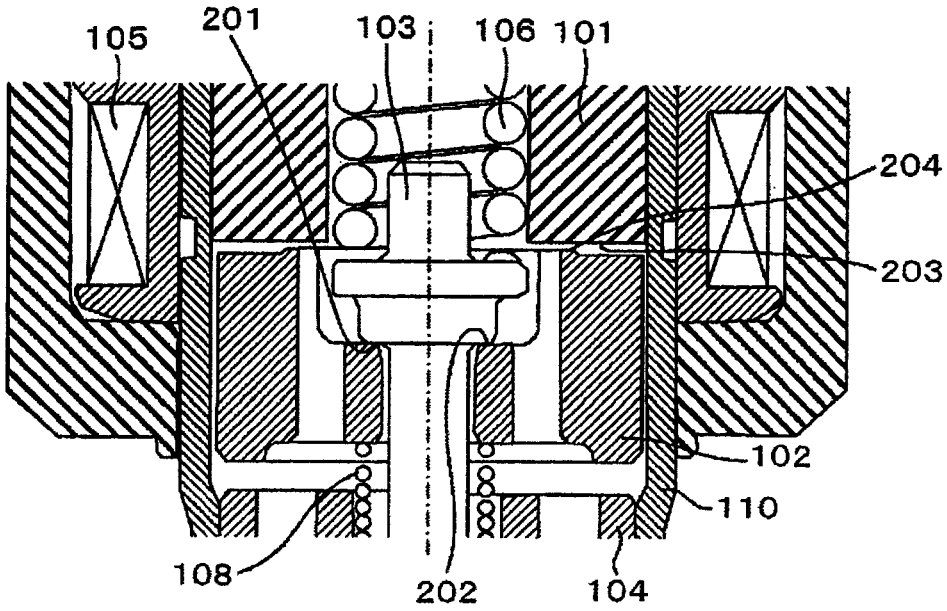
FIG. 2 A cross-sectional view showing colliding portions of a movable element and a valve element and an area in the vicinity of the colliding portions of the fuel injection valve according to a first embodiment of the present invention.

FIG. 1 is a cross-sectional view of a fuel injection valve 100 according to the present invention, and FIG. 2 is an enlarged view showing a magnetic core 101 (also referred to as a fixed core or simply as a core) which generates a magnetic attraction force and a movable element 102 (also referred to as a movable core) and an area in the vicinity of the magnetic core 101 and the movable element 102 in an enlarged manner. The fuel injection valve shown in FIG. 1 and FIG. 2 is a normally-closed-type electromagnetic valve (electromagnetic fuel injection valve). In a state where a coil 105 is not energized, a seat portion 103*a* which is formed on a distal end portion of a valve element 103 is brought into close contact with a valve seat 111*a* which is formed on a nozzle 111 by a spring 106 so that the valve assumes a closed state (valve closed state). In this valve closed state, the movable element 102 is biased in the valve opening direction by a zero position spring 108 and is brought into contact with a collision surface 201 (see FIG. 2; also referred to as a contact surface) of the valve element 103 thus providing a state where a gap is formed between the movable element 102 and the magnetic core 101. A size of the gap agrees with a lift amount of the valve element 103 when the valve is opened and is referred to as a stroke. A rod guide 104 which guides a rod portion 103*b* formed between the seat portion 103*a* and the collision surface 201 of the valve element 103 is fixed to a housing 110 which houses the valve element 103 therein, and the rod guide 104 constitutes a spring seat for the zero position spring 108. Here, a biasing force generated by the spring 106 is already adjusted by a pushing amount of a spring holder 107 which is fixed to an inner diameter (a through hole which penetrates in the axis A direction) 101*a* of the magnetic core 101 at the time of assembling.

The coil 105 and the magnetic core 101 constitute an electromagnet which forms a drive part for driving the valve element 103. The spring 106 which constitutes a first biasing portion biases the valve element 103 in the direction opposite to the direction of a drive force generated by the drive part. The zero position spring 108 which constitutes a second biasing portion biases the movable element 102 in the direction of the drive force with a biasing force smaller than a biasing force generated by the biasing spring 106.

When an electric current is supplied to the coil 105, a magnetic flux is generated in a magnetic circuit which is constituted of the magnetic core 101, the movable element 102 and a yoke 109, and the magnetic flux also passes through the gap formed between the movable element 102 and the magnetic core 101. As a result, a magnetic attraction force acts on the movable element 102, when the sum of the generated magnetic attraction force and a biasing force generated by the zero position spring 108 exceeds a force generated by a fuel pressure and a biasing force generated by the spring 106, the movable element 102 is displaced toward the core 101. When the movable element 102 is displaced, a force is transmitted between a collision surface 202 (see FIG. 2, also referred to as a contact surface) on a movable element 102 side and the collision surface 201 on a valve element 103 side so that the valve element 103 is also displaced simultaneously whereby the valve element 103 assumes a valve open state. When the valve element 103 assumes the valve open state, the seat portion 103*a* of the valve element 103 is moved away from the valve seat 111*a* so that fuel is supplied to a fuel injection hole 111*b* through the gap formed between the valve seat 111*a* and the seat portion 103*a* and fuel is injected from the fuel injection hole 111*b*.

When the supply of an electric current to the coil 105 is stopped from the valve open state, a magnetic flux which flows through the magnetic circuit is decreased so that a magnetic attraction force which acts between the movable element 102 and the core 101 is lowered. Here, a biasing force generated by the spring 106 which acts on the valve element 103 is transmitted to the movable element 102 by way of the collision surface 201 on a movable element 102 side and the collision surface 202 on a valve element side. Accordingly, when the sum of a force generated by the fuel pressure and a biasing force generated by the spring 106 exceeds the sum of the magnetic attraction force and a biasing force generated by the zero position spring 108, the movable element 102 and the valve element 103 are displaced in the valve closing direction so that the valve assumes a valve closed state.

As shown in FIG. 1 and FIG. 2, the valve element 103 is formed into a stepped rod shape thus forming the collision surface 201 on a valve element 103 side, and a hole having a diameter smaller than an outer diameter of the collision surface 201 is formed at the center of the movable element 102 side thus forming the collision surface (also referred to as a contact surface) 202 on a movable element 102 side. As a result, a transmission of force is performed between the collision surface 201 on a valve element 103 side and the collision surface 202 on a movable element 102 side and hence, even when the movable element 102 and the valve element 103 are provided as separate parts separated from each other, the movable element 102 and the valve element 103 can perform the basic opening and closing operation of the electromagnetic valve. The collision surfaces 201, 202 function as restricting portions for restricting the displacement of the movable element 102 relative to the valve element 103 in the direction of a drive force.

The collision surface 202 on a movable element 102 side is brought into contact with the collision surface 201 on a valve element 103 side only by a biasing force generated by the zero position spring 108. Further, when the movable element 102 receives a drive force from a state where the movable element 102 is brought into contact with the valve seat 111*a* and is held stationary, before the movable element 102 starts the movement thereof, the collision surface 202 on a movable element 102 side is brought into contact with the collision surface 201 on a valve element 103 side. Here, no stopper is particularly provided to the valve element 103 with respect to the movement of the valve element 103 in the direction that the valve element 103 is moved away from the valve seat 111*a* and hence, when the spring 106 is brought into a fully shrunken state, the furthermore movement of the valve element 103 is restricted. That is, the movement of the valve element 103 in the direction away from the valve seat 111*a* is restricted only by the spring 106.

Figure 3:
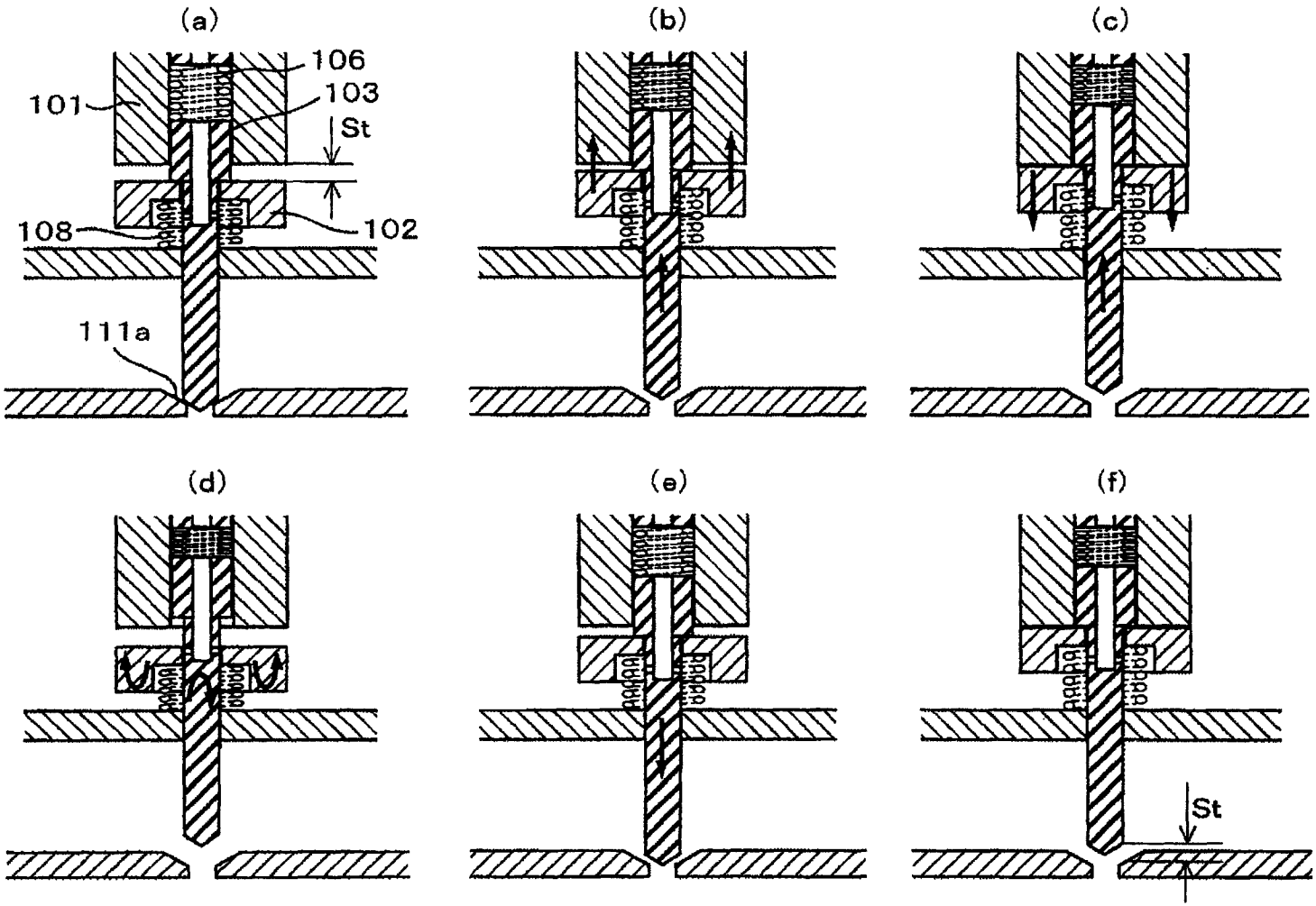
FIG. 3 A schematic view showing the movement of the movable element and the valve element of the fuel injection valve according to the first embodiment of the present invention at the time of opening the valve.

FIG. 3 is a schematic view showing a valve opening operation of the valve element 103 and the movable element 102 of the fuel injection valve 100. The valve element 103 which is preliminarily biased by the spring 106 is pushed to the valve seat 111*a* so that the valve is in a closed state (FIG. 3(*a*)). When a magnetic attraction force is generated between the magnetic core 101 and the movable element 102 and the sum of the magnetic attraction force and a biasing force generated by the zero position spring 108 exceeds the sum of a biasing force generated by the spring 106 and a force generated by a fuel pressure, the movable element 102 and the valve element 103 start the displacement thereof (FIG. 3(*b*)).

When the movable element 102 collides with the magnetic core 101, the movable element 102 cannot be further displaced in the upward direction. However, the upward movement of the valve element 103 is restricted only by the spring 106 and hence, the valve element 103 continues the further upward displacement thereof (FIG. 3(*c*)). Here, the biasing force generated by the spring 106 and the force generated by the fuel pressure acts on the valve element 103 in the downward direction so that the valve element 103 starts the displacement in the downward direction soon (FIG. 3(*d*)). When the overshooting of the valve element 103 occurs, there arises a drawback that an actual stroke value does not agree with a target stroke value in a minute fuel injection zone so that the controllability of an injection amount in the minute fuel injection zone is deteriorated. Accordingly, to improve the injection amount property in such a minute fuel injection zone, it is necessary for the valve element 103 to finish the overshooting within a short time and with small amplitude and to return to a target stroke position. Accordingly, it is desirable to increase a biasing force generated by the spring 106 which acts on the valve element 103 in the direction that the overshooting is suppressed and to reduce a mass of the valve element 103. Further, since the biasing force generated by the spring 106 is a force which acts on the valve element 103 in the direction opposite to the direction of a drive force, the valve element 103 is quickly closed at the time of closing the valve by increasing the biasing force generated by the spring 106 so that the improvement of valve closing responsiveness can be also expected.

Further, at the time of opening the valve, since the movable element 102 and the valve element 103 are formed as separate parts from each other, after colliding with the magnetic core 101, the movable element 102 is separated from the valve element 103 and bounds in the downward direction (FIG. 3(*c*)). Here, a biasing force generated by the zero position spring 108 and a magnetic attraction force act on the bounded movable element 102 in the upward direction, and the movable element 102 starts the displacement thereof in the upward direction soon (FIG. 3(*d*)). After the overshooting at the time of opening the valve, the valve element 103 continues the displacement in the downward direction and bounds due to the collision with the magnetic core 101, and the displacement of the valve element 103 in the downward direction is restricted by the collision with the movable element 102 which continues the displacement (FIG. 3(*e*)). After the collision between the movable element 102 and the magnetic core 101 and the collision between the movable element 102 and the valve element 103 are repeated plural times, the movable element 102, the magnetic core 101 and the valve element 103 are brought into a stable valve open state where these parts are set stationary (FIG. 3(*f*)). Such bounding of the movable element 102 at the time of opening the valve dissociates an injection amount property with respect to a injection pulse width from an approximately proportional straight line and becomes a cause of irregularities in the injection amount property. Accordingly, the suppression of a bounding amount of the movable element 102 is effective in acquiring a more minute control of an injection amount by approximating the injection amount property to a straight line.

That is, to quickly stabilize the valve element 103, it is necessary to restrict the displacement in the downward direction of the valve element 103, that is, to reduce the bounding of the movable element 102. Since a biasing force generated by the zero position spring 108 and a magnetic attraction force act on the movable element 302 in the midst of bounding in the direction toward the magnetic core 101, the increase of both the biasing force and the magnetic attraction force is effective to reduce a bounding amount. Particularly, when the bounding can be reduced only by the zero position spring 108, the injection amount property can be improved independently from a drive circuit or a waveform of an electric current so that the reduction of bounding only by the zero position spring 108 is desirable. Accordingly, it is desirable that the bounding of the movable element 102 is reduced by increasing a biasing force generated by the zero position spring 108. Here, magnitude of a magnetic attraction force is inversely proportional to the square of the gap formed between the magnetic core 101 and the movable element 102 and hence, by strengthening the zero position spring 108 thus reducing a bounding amount, the lowering of a magnetic attraction force during bounding of the movable element 102 can be suppressed whereby a large valve element stabilizing effect can be acquired. By further increasing a biasing force generated by the zero position spring 108, a large biasing force generated by the spring 106 can be set and hence, this embodiment can also expect a secondary advantageous effect that the overshooting of the valve element 103 at the time of opening the valve can be reduced.

Further, to stabilize the valve element 103 within a short time by reducing the bounding of the movable element 102, it is desirable that collision surfaces 203, 204 (see FIG. 2, also referred to as contact surfaces) of the movable element 102 and the magnetic core 101 and the collision surfaces 201, 202 of the movable element 102 and the valve element 103 have small restitution coefficients while ensuring durability. Further, it is desirable that a mass of the movable element 102 is small. The collision surface 203 is an end surface of the magnetic core 101 which faces a movable element 102 side, and the collision surface 204 is a top surface of a projecting portion which is formed on an end surface of the movable element 102 which faces a magnetic core 101 side. The projecting portion which is formed on the movable element 102 may be formed on the magnetic core 101 side.

As described above, this embodiment provides the fuel injection valve which can easily control a minute fuel injection amount in such a manner that the bounding of the movable element 102 at the time of opening the valve can be suppressed independently from a drive circuit or a waveform of an electric current by strengthening a biasing force generated by the zero position spring 108.

Figure 4:
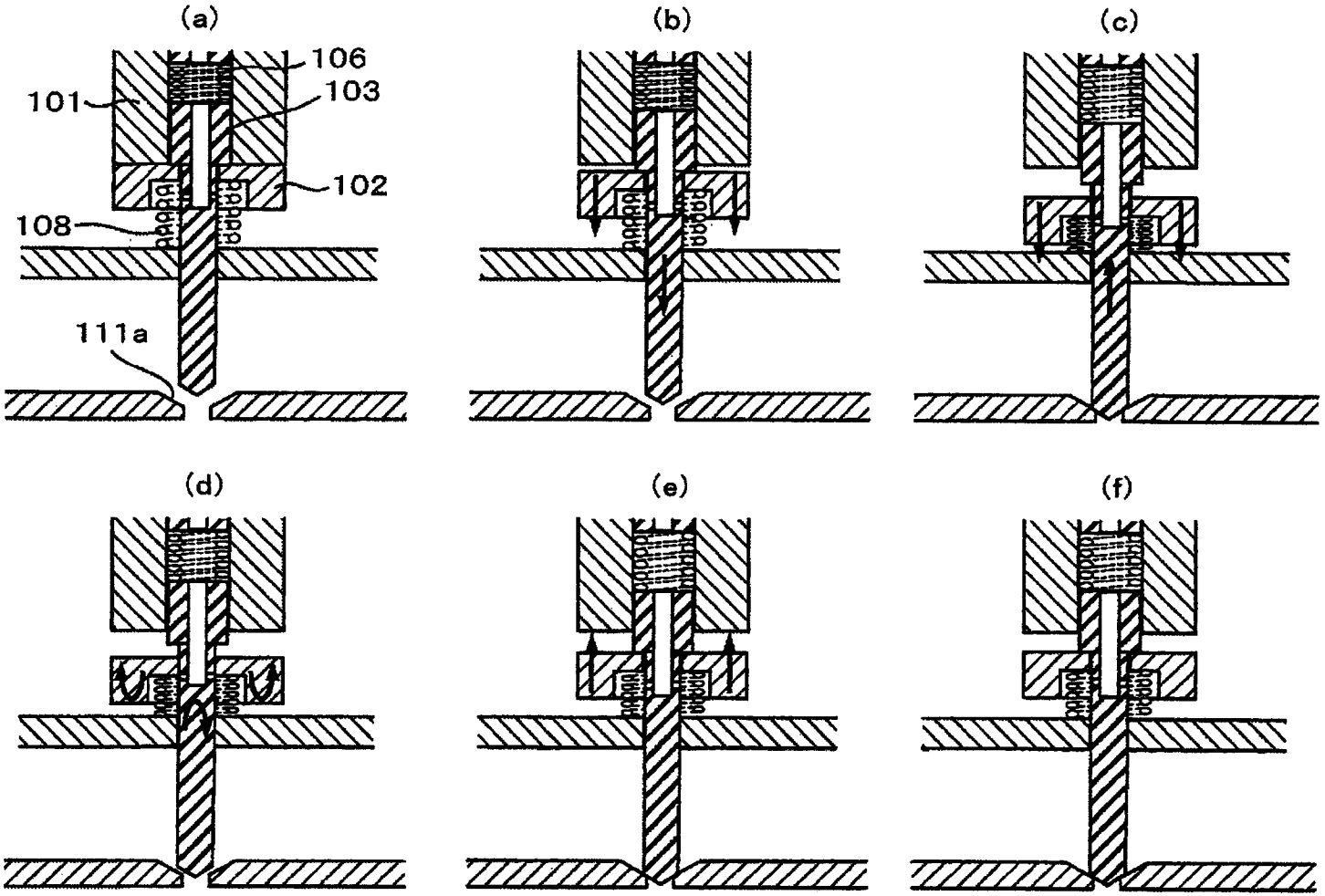
FIG. 4 A schematic view showing the movement of the movable element and the valve element of the fuel injection valve according to the first embodiment of the present invention at the time of closing the valve.

FIG. 4 is a schematic view showing a valve closing operation of the valve element 103 and the movable element 102 of the fuel injection valve 100. FIG. 4(*a*) is a view showing a state of the valve in a valve open state where the movable element 102 is lifted up due to a magnetic attraction force which acts between the magnetic core 101 and the movable element 102. When the energization to the coil 105 is interrupted so that an attraction force acting between the magnetic core 101 and the movable element 102 becomes small, the valve element 103 receives a biasing force generated by the spring 106 and starts an operation in the valve closing direction together with the movable element 102 (FIG. 4(*b*)). When the valve element 103 continues the further displacement, the valve element 103 collides with the seat portion 111*a* soon as shown in FIG. 4(*c*). Since the valve element 103 and the movable element 102 adopt the separable structure, after the valve element 103 and the seat portion 111*a* collide with each other, the valve element 103 is displaced in the upward direction due to bounding thereof, while the movable element 102 continues the displacement in the downward direction. Here, a biasing force generated by the spring 106 and a force generated by a fuel pressure act on the bounded valve element 103 in the downward direction and amass of the valve element 103 is small and hence, the valve element 103 is quickly displaced in the downward direction and closes the valve (FIG. 4(*d*)). To suppress the bounding of the valve element 103 after the valve is closed, it is effective to increase the biasing force generated by the spring 106 which acts on the valve element 103 in the direction that bounding is suppressed and to decrease amass of the valve element 103. Further, it is desirable that the collision surfaces of the valve element 103 and the seat portion 111*a* have small restitution coefficients while ensuring durability.

On the other hand, a biasing force generated by the zero position spring 108 in the upward direction acts on the movable element 102 which continues the displacement in the downward direction, and the movable element 102 starts the displacement in the upward direction soon (FIG. 4(*d*)). The movable element 102 which continues the upward displacement collides with the valve element 103 which continues the displacement after bounding or is already in a stable valve closed state so that the upward displacement of the movable element 102 is restricted (FIG. 4(*e*)). After the collision between the valve element 103 and the seat portion 111*a* and the collision between the movable element 102 and the valve element 103 are repeated plural times, the movable element 102 and the valve element 103 are brought into a stable valve closed state where these parts are set stationary (FIG. 4(*f*)). Here, the movable element 102 is moved while forming a spring-mass system between the movable element 102 and the zero position spring 108. When a biasing force generated by the zero position spring 108 is sufficiently small, even when the movable element 102 returns to a position shown in FIG. 4(*f*), the valve element 103 is not opened again, or even when the valve element 103 is opened again, the influence exerted on the valve operation by the opening of the valve element 103 can be made small. As a result, it is possible to suppress the secondary injection where fuel is injected due to bounding of the valve element 103 caused by the re-collision of the valve element 103 and the movable element 102 after closing the valve. In view of the above, to set a biasing force of the zero position spring 108 with which bounding of the valve element 103 in the re-collision of the movable element 102 with the valve element 103 after overshooting of the movable element 102 at the time of closing the valve can be reduced, inventors of the present invention have studied the movement of the movable element 102 from a point of time that the overshooting of the movable element 102 occurs to a point of time that the re-collision with the valve element 103 occurs after closing the valve.

Firstly, the equation of motion during overshooting of the movable element 102 after closing the valve is studied. Here, a force which acts on the movable element 102 is only a biasing force $F_z$ [N] generated by the zero position spring 108. Accordingly, assuming a mass of the movable element 102 as $m_a$ [kg] and acceleration as $a_1$ [m/s$^2$], the equation of motion is expressed as follows.

$$F_z=m_a \cdot a_1 \tag{1}$$

Here, the main purpose of studying the equation of motion is to grasp the tendency of correlation between respective parameters and the secondary injection and hence, friction resistances of the respective slide portions, the fluid resistance and the like are ignored.

Next, the non-elastic collision when the overshot movable element 102 collides with the valve element 103 again is studied. Here, assuming a mass of the valve element 103 as $m_p$ [kg] and the respective speeds of the movable element 102 and the valve element 103 before collision as $v_{A1}$ [m/s] and $v_{P1}$ [m/s], and the respective speeds of the movable element 102 and the valve element 103 after collision as $v_{A2}$ [m/s] and $v_{P2}$ [m/s], an impulse equation at the time of non-elastic collision is expressed by a following equation. Here, assume a restitution coefficient of the movable element 102 and the valve element 103 as $e_1$.

$$e_1-(v_{A2}-v_{P2})/(v_{A1}-v_{P1}) \tag{2}$$

$$F_Z \cdot \Delta t=m_a(v_{A2}-v_{A1})+m_p(v_{P2}-v_{P1}) \tag{3}$$

$\Delta t$ is a collision time [s] when the movable element 102 collides with the valve element 103, and expresses a time during which a biasing force generated by the zero position spring 108 acts on the valve element 103 via the movable element 102. The speed $v_{P1}$ of the valve element 103 is set to zero by assuming that the valve element 103 is already stabilized before the valve element 103 collides with the movable element 102 again, and it is assumed that the speed $v_{A1}$ of the movable element 102 before collision is equal to the valve closing speed $v_0$ [m/s] of the movable element 102 and the valve element 103 in the midst of overshooting based on the principle of energy conservation. A following equation is obtained by solving equations (2), (3) as the simultaneous equations and by arranging the equations (2), (3) with respect to a biasing force $F_Z$ generated by the zero position spring 108.

$$F_Z=-(m_a(1+e_1)/\Delta t)v_0+((m_a+m_p)/\Delta t)v_{P2} \tag{4}$$

It is found that the term which relates to the generation of the secondary injection in the equation (4) is only the speed $v_{P2}$ of the valve element 103 after collision, and a biasing force of the zero position spring 108 which does not generate the secondary injection has the linear relationship with the valve closing speed $v_0$. The valve closing speed $v_0$ changes corresponding to a valve lift amount or setting of a biasing spring. Accordingly, it is found that even when a valve lift amount or setting of spring changes, it is sufficient to set a biasing force of the zero position spring 108 with respect to a valve closing speed.

Figure 5:
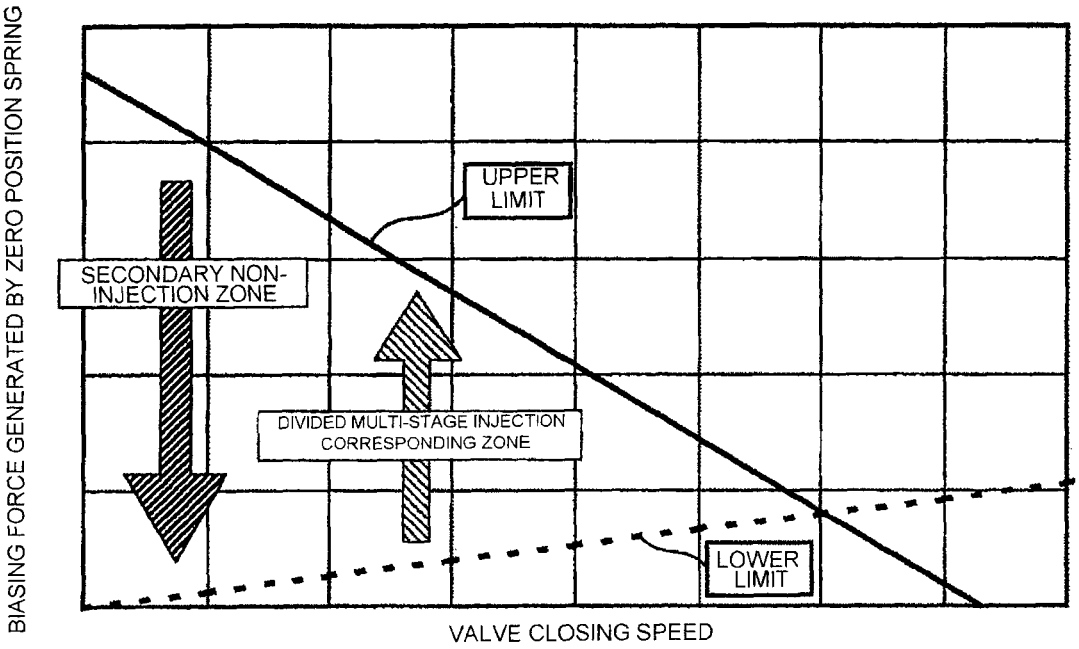
FIG. 5 A graph showing a setting range of a biasing force generated by a zero position spring and a valve closing speed of the valve element in the fuel injection valve according to the first embodiment of the present invention.

A solid line in FIG. 5 is a result obtained by actually investigating the correlation among the valve closing speed $v_0$, the biasing force $F_Z$ of the zero position spring 108 and the presence or non-presence of the generation of the secondary injection when a mass of the movable element 102 and a mass of the valve element 103 are assumed as 1 kg, and the solid line indicates a border line between the presence and the non-presence of the generation of the secondary injection. The secondary injection is generated above the solid line, and the secondary injection is not generated below the solid line. FIG. 5 indicates that, as expressed by the equation (4), the biasing force $F_Z$ of the zero position spring 108 can be arranged corresponding to the valve closing speed. Accordingly, from a viewpoint of preventing the generation of the secondary injection, the biasing force $F_Z$ of the zero position spring 108 is desirably set below the relation equation expressed by the solid line. When the solid line shown in FIG. 5 is numerically expressed, it is found that the following relationship is established.

$$F_Z=-7.5\times10^3\times m_a\times v_0+2.6\times10^3\times(m_a+m_p) \tag{5}$$

A coefficient $7.5\times10^3$ in this equation is a coefficient constituted of parameters of a restitution coefficient of the movable element 102 and the valve element 103 and a collision time in the equation (4), and a coefficient $2.6\times10^3$ is a coefficient constituted of parameters of a speed of the valve element 103 after the movable element 102 and the valve element 103 collide with each other and a collision time in the equation (4). As shown in the equation (4), by revealing that the biasing force of the zero position spring 108 which can prevent the generation of the secondary injection can be arranged based on the valve closing speed, the relation equation which includes terms whose measurement is difficult in an actual operation such as a restitution efficient or a collision time can be obtained in accordance with the equation (5).

As described above, by setting a biasing force $F_Z$ generated by the zero position spring 108 to a value set based on the equation (5) or less, bounding caused by re-collision of the valve element 103 with the movable element 102 at the time of closing the valve can be suppressed, and a secondary injection amount generated by the bounding can be reduced. It is necessary to set the biasing force $F_Z$ generated by the zero position spring 108 to a magnitude at which it is possible to maintain a state where the collision surface 202 of the movable element 102 is brought into contact with the collision surface 201 of the valve element 103 in a non-energized state. Accordingly, the biasing force $F_Z$ generated by the zero position spring 108 is set to a value larger than a product of a mass of the movable element 102 and acceleration g of gravity (9.8 m/s$^2$).

Further, to suppress the secondary injection caused by the re-collision of the movable element 102 and the valve element 103 at the time of closing the valve, it is also effective to set a restitution coefficient to a small value while ensuring durability of the collision surfaces of the movable element 102 and the valve element 103.

From a viewpoint of the prevention of the secondary injection, a biasing force generated by the zero position spring 108 is desirably as small as possible. On the other hand, the biasing force generated by the zero position spring 108 is desirably as large as possible from a viewpoint of divided multi-stage injection. Hereinafter, from a viewpoint of divided multi-stage injection, the study is made with respect to the behavior of the movable element 102 from overshooting to the re-collision with the valve element 103 after closing the valve.

Currently, in the midst of progress of downsizing of engines, soot which is generated due to adhesion of fuel to a wall surface of a combustion chamber at the time of high load combustion causes a problem. To suppress this problem, it is effective to reduce an amount of fuel adhering to the wall surface of the combustion chamber by shortening penetration at the time of injecting fuel. Here, when a certain fuel injection amount is necessary during combustion, it is difficult to reduce the penetration with the single injection. However, by adopting the divided multi-stage injection where fuel is injected plural times by division during one stroke of the engine, a fuel injection amount per one time can be reduced while ensuring a required fuel injection amount and hence, the penetration can be shortened. Further, the injection is performed after a lapse of a fixed interval at the time of performing the injection of second time or at the time of performing the injections of succeeding times so that the resistance in injection is increased compared to the single injection whereby the penetration can be shortened. Accordingly, the divided multi-stage injection is effective for shortening the penetration.

Here, in performing the divided multi-stage injection, when the injection is performed after a lapse of time from the preceding injection which is excessively shorter than the fixed interval at the time of performing the injection of second time or at the time of performing the injections of succeeding times, a phenomenon similar to the single injection occurs and hence, the advantageous effect that the penetration can be shortened by the divided multi-stage injection cannot be obtained.

Figure 6:
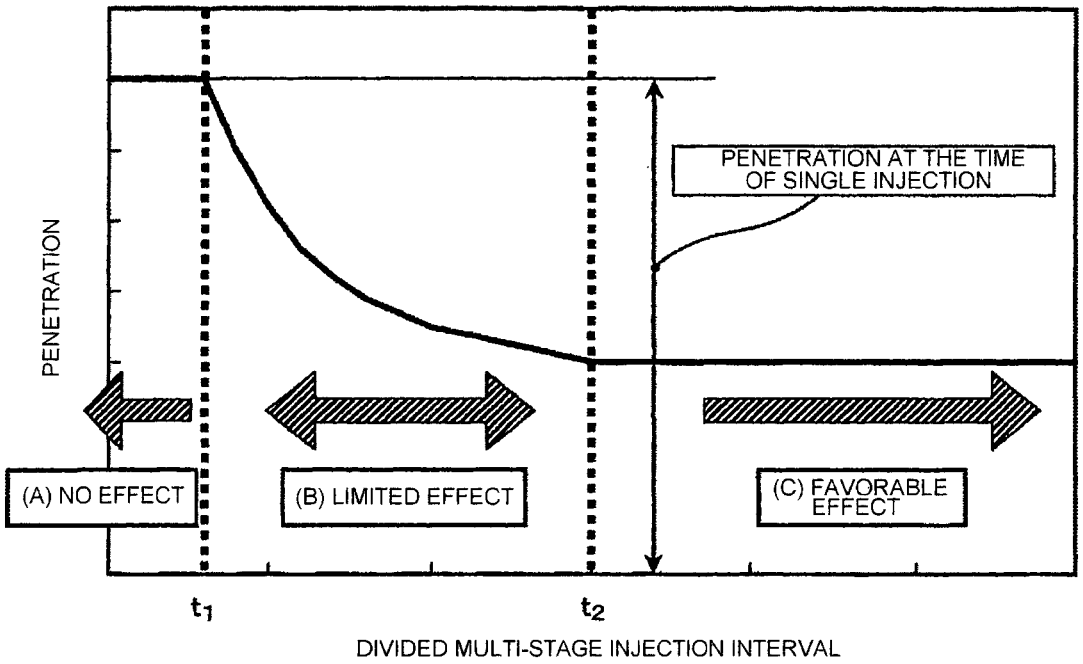
FIG. 6 A view showing the correlation between a divided multi-stage injection interval and the penetration in the fuel injection valve according to the first embodiment of the present invention.

FIG. 6 is a view showing the correlation between a divided multi-stage injection interval and a penetration reducing effect. From this drawing, the penetration shortening effect is divided into three zones corresponding to the multi-stage injection interval. Firstly, in the zone (A) where the multi-stage injection interval is extremely short (injection interval being $t_1$ or less), the injection interval is extremely short. Accordingly, even when the multi-stage injection is performed, the behavior of the movable element 102 becomes substantially equal to the behavior of the movable element 102 when single injection is performed so that a penetration shortening effect cannot be acquired. Next, in the zone (B) (injection interval being $t_1$ or more and $t_2$ or less), the injection interval is increased compared to the injection interval in the zone (A) and hence, the penetration shortening effect can be acquired. However, the penetration shortening effect is limited. In the zone (C) where the injection interval is $t_2$ or more, the sufficient injection interval is ensured and hence, a penetration reduction effect can be acquired. In this manner, it is newly found that the advantageous effect brought about by the divided multi-stage injection can be sufficiently acquired in the zone where the injection interval is sufficiently ensured at the time of performing the injection two times or more so that continuous sprayings can be independently performed.

From the above, while it is desirable to shorten the multi-stage injection interval as much as possible from a viewpoint of the use of the engine, it is effective for a penetration reduction effect to set the multi-stage injection interval to the minimum injection interval $t_2$ or more where continuous sprayings can be independently performed at the time of performing the injection two times or more. Accordingly, it is desirable that the fuel injection valve has the performance which allows the multi-stage injection up to the fuel injection interval of $t_2$ or less.

The multi-stage injection interval which the fuel injection valve can cope with in a stable manner depends on a restoring time of the movable element 102 from overshooting after closing the valve. Accordingly, a force which acts on the movable element 102 at the time of overshooting is only a biasing force generated by the zero position spring and hence, to shorten the multi-stage injection interval, it is necessary to increase the biasing force generated by the zero position spring 108. Here, the equation of motion of the movable element at the time of overshooting is expressed by the equation (1), and an overshooting amount y [m] is expressed by the following equation assuming an overshooting time as t [s].

$$y=v_0\times t-(1/2)\times a_1\times t^2 \tag{6}$$

Further, when the movable element 102 collides with the valve element 103 again after overshooting, the movement of the movable element 102 is substantially stabilized at this collision of first time. Accordingly, if the movable element is restored after overshooting with a time shorter than the injection interval, the multi-stage injection can be performed. Accordingly, to solve the simultaneous equations (1) (6) by substituting a certain injection interval $t_2$[s] where the divided multi-stage injection is effective for the overshooting time t and by substituting 0 for the overshooting amount y, a biasing force $F_Z$ generated by the zero position spring 108 is expressed by the following equation.

$$F_Z=2.0\times ma/t_2\times v_0 \tag{7}$$

Accordingly, by setting the biasing force $F_Z$ generated by the zero position spring 108 to a value equal to or more than the value obtained by the equation (7), the divided multi-stage injection interval can be set to $t_2$ or less. A broken line shown in FIG. 5 indicates the relationship among a valve closing speed $v_0$, a biasing force $F_Z$ generated by the zero position spring 108 and a zone where injection interval becomes $t_2$ or less when a mass of the movable element 102 is assumed as 1 kg. The fuel injection valve can cope with the divided multi-stage injection interval $t_2$ or less in the zone above the broken line.

From the above, in FIG. 5, by setting the biasing force generated by the zero position spring 108 in the zone below the solid line and in the zone above the broken line, the fuel injection valve which copes with the divided multi-stage injection interval $t_2$ or less can be realized while preventing the generation of secondary injection.

As described above, FIG. 7 shows a series of movements of the valve element 103 and the movable element 102 from a point of time that the valve element 103 and the movable element 102 start the movement thereof at the time of opening the valve to a point of time that the valve element 103 and the movable element 102 reach a stable state after closing the valve in the form of a time chart. With a slight delay time with respect to inputting of an injection control pulse (point of time a), both the movable element 102 and the valve element 103 start the displacement at a point of time b. When the movable element 102 reaches a predetermined stroke St, the movable element 102 bounds due to the collision with the magnetic core 101 at a point of time c. The valve element overshoots during a time from points of times c to d and, thereafter, collides with the movable element 102 at the point of time d, and returns to a stroke position together with the movable element 102 (point of time e). Due to the collision of the movable element 102 with the magnetic core 101 again in the same manner at the time of initial valve opening, the overshooting of the valve element 103 and the bounding of the movable element 102 are repeated at points of times e to f, and finally the valve element 103 and the movable element 102 are brought into a stable valve open state at a point of time g. When the inputting of the injection control pulse is finished (point of time h), the valve element and the movable element start the displacement thereof in the valve closing direction simultaneously. At a point of time i, the valve element bounds by a predetermined amount due to the contact of the valve element with the seat portion and, thereafter, the displacement is stopped. After overshooting, the movable element collides with the valve element with a biasing force generated by the zero position spring soon so that both the movable element and the valve element bound (point of time j). By repeating the collision plural times, eventually, the valve element and the movable element are brought into a stable valve closing state where both the valve element and the movable element are set stationary.

Figure 7:
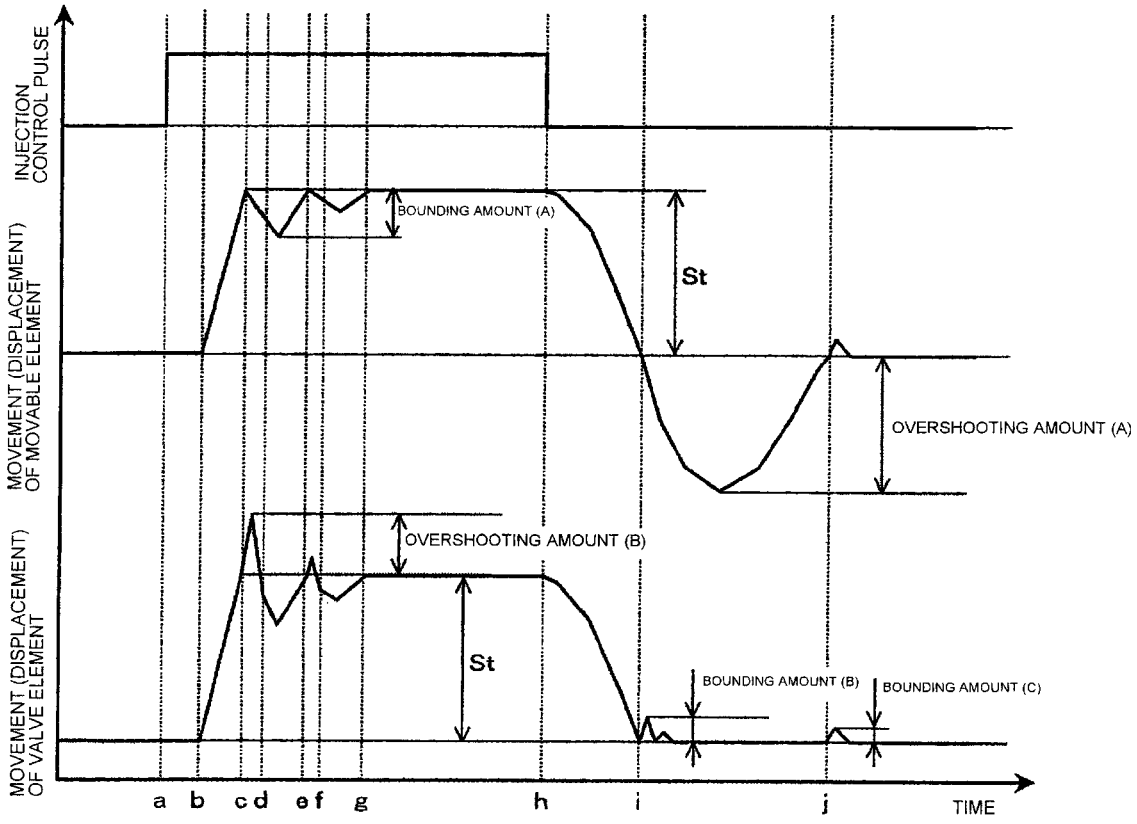
FIG. 7 A timing chart showing a valve opening/closing operation of the fuel injection valve according to the first embodiment of the present invention.

Here, by setting a biasing force generated by the zero position spring 108 to a larger value, a bounding amount (A) of the movable element shown in FIG. 7 can be reduced so that a time (from the point of time c to the point of time g) required until the bounding is finished can be also shortened. Further, when the overshooting of the movable element 102 is generated at the time of closing the valve, a biasing force generated by the zero position spring 108 acts in the direction that overshooting is suppressed and hence, an overshooting amount (A) is reduced, and a time (from the point of time i to the point of time j) required until the overshooting is finished can be also shortened. Further, a biasing force generated by the spring 106 can be increased by increasing the biasing force generated by the zero position spring 108 and hence, an overshooting amount (B) of the valve element 103 at the time of opening the valve and a bounding amount (B) of the valve element 103 due to the collision of the valve element 103 with the seat portion 111*a* at the time of closing the valve can be reduced whereby a valve opening and closing cycle can be shortened.

On the other hand, by setting a biasing force (N: Newton) generated by the zero position spring 108 smaller than a sum of a value which is obtained by multiplying a product of a valve closing speed (m/s: meter per second) of the valve element 103 and a mass (kg: kilogram) of the movable element 102 by $-7.5\times10^3$ and a value which is obtained by multiplying a sum (kg: kilogram) of the mass of the movable element 102 and a mass of the valve element 103 by $2.6\times10^3$, a bound amount (C) generated due to the collision between the valve element 103 and the movable element 102 shown in FIG. 7 can be reduced so that a time required until the bounding is finished can be also shortened whereby the secondary injection can be eliminated.

Further, by reinforcing a biasing force (N: Newton) generated by the zero position spring 108, a restoring time (i in FIG. 7 to j in FIG. 7) of the movable element 102 from overshooting at the time of closing the valve can be shortened. Further, by setting the biasing force (N: Newton) generated by the zero position spring 108 larger than a value obtained by multiplying a value which is obtained by dividing the product of the valve closing speed (m/s: meter per second) of the valve element 103 and the mass (kg: kilogram) of the movable element 102 by a minimum injection interval $t_2$ (s: second) by which continuous sprayings can be independently performed when the injection is performed 2 times or more by 2.0, the injection can be performed two times or more in one stroke of the internal combustion engine at an injection interval of $t_2$ or less.

As has been explained heretofore, according to the embodiment, the valve body can be operated in a stable manner at the time of opening the valve, and the secondary injection can be suppressed by suppressing rebounding of the valve element 103 at the time of closing the valve. Accordingly, the control of a minute fuel injection amount can be finely performed so that a controllable range of a fuel injection amount can be expanded. Further, the behavior of the movable element 102 can be quickly stabilized after the valve is closed so that the multi-stage injection can be realized and the generation of soot can be suppressed at the time of combustion in an actual operation.

Although various embodiments and modifications have been explained heretofore, the present invention is not limited to these contents. Other modes which are conceivable within the technical concept of the present invention also fall within the scope of the present invention.

The content of the disclosure of the following basic application from which the present application claims priority is incorporated in this specification in the form of cited document.

Japanese Patent Application 2010-084778 (filed on Apr. 1, 2010).

The invention claimed is:

1. An electromagnetic fuel injection valve comprising:

a valve element which closes a fuel passage by coming into contact with a valve seat and opens the fuel passage by going away from the valve seat;

an electromagnet which includes a coil and a magnetic core formed as a drive portion for driving the valve element;

a movable element which is held by the valve element in a state where the movable element is displaceable in the direction of a drive force of the valve element relative to the valve element;

a first biasing portion for biasing the valve element in the direction opposite to the direction of a drive force generated by the drive portion;

a second biasing portion for biasing the movable element in the direction of the drive force with a biasing force smaller than the biasing force generated by the first biasing portion; and a restricting portion for restricting the displacement of the movable element in the direction of the drive force relative to the valve element, wherein the biasing force (N) of the second biasing portion is set smaller than a sum of: i) a value which is obtained by multiplying a product of a valve closing speed (m/s) of the valve element and a mass (kg) of the movable element by $-7.5\times10^3$ (l/s), and ii) a value which is obtained by multiplying a sum of the mass of the movable element and a mass of the valve element by $2.6\times10^3$ ($m/s^2$).

2. The electromagnetic fuel injection valve according to claim 1, wherein the biasing force (N) of the second biasing portion is set larger than a value obtained by multiplying a value which is obtained by dividing the product of the valve closing speed (m/s) of the valve element and the mass (kg) of the movable element by a minimum injection interval (s) by which continuous sprayings are independently performable when the injection is performed 2 times or more by 2.0.

* * * * *